United States Patent [19]

Artz et al.

[11] Patent Number: 4,770,228

[45] Date of Patent: Sep. 13, 1988

[54] METAL CASTING DEVICE EQUIPPED WITH A CONTINUOUSLY ROTATING SUPPORTING ELEMENT

[75] Inventors: Gerd Artz, Ratingen; Herbert Berendes, Mülheim; Dieter Figge, Essen, all of Fed. Rep. of Germany

[73] Assignee: Fried. Krupp Gesellschaft mit beschränkter Haftung, Essen, Fed. Rep. of Germany

[21] Appl. No.: 130,106

[22] Filed: Dec. 7, 1987

[30] Foreign Application Priority Data

Dec. 19, 1986 [EP] European Pat. Off. ..... 86117792.1

[51] Int. Cl.[4] ..... B22D 11/06

[52] U.S. Cl. ..... 164/430; 164/435; 164/436; 164/330

[58] Field of Search ..... 164/429, 430, 435, 436, 164/479, 491, 328, 329, 330, 331, 323, 324

[56] References Cited

U.S. PATENT DOCUMENTS 1,863,371 6/1932 Greene ..... 164/430
3,384,153 5/1968 Boehm .
3,835,917 9/1974 Gyongyos .
4,444,244 4/1984 Petit ..... 164/429
4,510,990 4/1985 Artz et al. .
4,537,240 8/1985 Tsuchida et al. .

FOREIGN PATENT DOCUMENTS 0174922 3/1986 Fed. Rep. of Germany .
1235728 6/1971 United Kingdom .

*Primary Examiner*—Kuang Y. Lin
*Attorney, Agent, or Firm*—Spencer & Frank

[57] ABSTRACT

A metal casting device employs a number of pairs of mold members which can be opened or closed with respect to each other. The mold chamber pairs cooperate, in their closed state, to form a linear mold chamber. In order to compensate for shrinkage as the metal cools, the mold member pairs are movably supported by an endless chain, with the pairs of cooperating mold members being provided with contact faces having the same angle of inclination. Each mold member pair is also equipped with supporting rollers with which the associated mold chamber section can be closed or opened, as required.

14 Claims, 9 Drawing Sheets

METAL CASTING DEVICE EQUIPPED WITH A CONTINUOUSLY ROTATING SUPPORTING ELEMENT

BACKGROUND OF THE INVENTION

The present invention relates to a metal casting device equipped with a continuously rotating supporting element on which a plurality of mutually movable pairs of mold members, each representing a mold chamber section, are carried in succession in the circumferential direction along with the supporting element, the casting device further including adjustment elements by means of which the mold chamber—which is formed of some of the mold member pairs which then rest against one another in the circumferential direction—is closed in the region of the metal intake and—when seen in the circumferential direction—can be opened at a given distance therefrom.

High casting speeds (up to 10 m/min) can be realized with casting devices which are configured primarily as twin belt casters or casting wheels. The twin belt caster has a linear mold chamber from which the cast product is able to leave without unfavorable deformation and whose length does not influence, or at least only insignificantly influences, the structural height of the machine. The drawback of this prior art casting device is that it is technically complicated and, under certain circumstances, cannot be used economically in cases in which relatively small casting outputs are required.

In contrast thereto, casting devices in the form of casting wheels are of relatively simple construction but have the particular drawback that the length of the mold chamber given by the metallurgical conditions results in a large wheel diameter with a corresponding structural height of the machine. As a result of the curvature of the mold chamber, the casting is subjected to unfavorable bending stresses. Moreover, irregular cooling of the developing casting at its upper and undersides cannot be avoided.

U.S. Pat. No. 4,537,240 discloses a casting device of the above-mentioned type in the form of a casting wheel whose mold chamber is defined, on the one hand, by the rim of the wheel and, on the other hand, by pivotally mounted mold halves. The mold halves can be brought into a closed position by means of cylinders so as to seal the mold chamber toward the exterior or the mold halves can be moved into an open position by pivoting them away from the wheel circumference in order to permit removal of the casting from the region of the casting wheel. The two contacting areas by way of which the pairs of mold members of the embodiment under discussion here support themselves on one another are perpendicular to one another; the cross section of the mold chamber can therefore not be adapted to the shrinking processes occurring when the liquid metal solidifies.

U.S. Pat. No. 3,835,917 discloses a casting device having a worm-type mold which is formed by two rotating caterpillar chains which cooperate with one another in the region of the mold chamber. This prior art casting device as well does not permit adaptation of the mold chamber cross section to the above-mentioned shrinking processes.

SUMMARY OF THE INVENTION

It is an object of the present invention to provide a casting device which is equipped, in an economically justifiable manner, so that a linear mold chamber is formed, the mold chamber being configured in such a manner that the shrinking during solidification is at least partially compensated.

This is accomplished, in a casting device of the type which includes a continuously rotating supporting element on which a plurality of pairs of mold members are fastened, in that the supporting element is configured as an endless chain which is supported in the region of the metal intake and in the region of the end of the mold chamber at front and rear chain wheels; in that all contact faces by which the mold numbers of each mold member pair support each other have the same angle of inclination with respect to a reference plain and overlap one another alternatingly in the closed position; and in that outside the endless chain, each mold member pair is equipped with a plurality of differently oriented supporting rollers which, at least in the region of the mold chamber, lie against stationary guides to keep the associated mold members in contact with one another while forming a mold chamber section. The basic idea of the invention thus resides in the use of an endless chain running in the shape of an oval over chain wheels. The endless chain is equipped with relatively movable mold member pairs which are guided at least in the region of the mold chamber by means of suitably aligned supporting rollers and which temporarily form a mold chamber section with one another. By the cooperation of a plurality of mold member pairs in succession in the direction of rotation, an uninterrupted mold chamber is created in a region in which the endless chain is linear. The length of the mold chamber is determined by the number of mold member pairs whose mold members take on a closed position (between the metal intake region and the end of the mold chamber). A change in the mold chamber cross section so as to adapt it to shrinking processes is made possible in that all areas of contact by which the mold members of each mold member pair can be supported against one another have the same angle of inclination with respect to a reference plane (if the mold chamber is arranged horizontally, for example with respect to the horizontal plane through the longitudinal axis of the mold chamber) and overlap one another alternatingly in the closed position. In particular, the coinciding angle of inclination may be 0°.

The mold chamber extending between the chain wheels may have any desired slope, i.e. it may be horizontal, inclined, or perpendicular. The significant feature with respect to the desired shrinkage compensation is that the respective pairs of cooperating mold members—in close contact with one another in the closed position—are configured and associated with each other such that the cooperating mold members are able to be moved with respect to one another perpendicularly to the longitudinal axis of the mold chamber (and thus to the direction of rotation in the region of the mold chamber). Preferably the contact areas between the mold members of each mold member pair are oriented in such a manner that displacement transversely to the longitudinal axis of the mold chamber does not bring about a change in the height dimension of the mold member pairs. If, for example, the casting device has a mold chamber with a rectangular cross section, the contact areas of the cooperating mold members extend parallel to the uppe or lower wall of the mold chamber. Each mold member thus supports a mold wall section which—when seen perpendicularly to the longitudinal axis of the mold chamber—has an angular shape. One mold member may, for example, form the lower wall and the left side wall of the respective mold chamber section, with the associated second mold member including a section of the upper wall and the right side wall of the mold chamber.

To ensure that the endless chain takes on the most uniform, reproducible position over the length of the mold chamber, the endless chain is equipped with roller bearings which are supported, at least in the region of the mold chamber, on a guide path. Preferably, the connection between the mold member pairs and the endless chain is such that each mold member pair has two associated pairs of roller bearings which follow one another in the direction of rotation; thus, every two adjacent mold member pairs have a common roller bearing pair at the endless chain.

The invention is further characterized in that the mold member of each mold member pair which supports the mold wall section on the outside with respect to the endless chain is movable with respect to the endless chain. If the mold chamber is horizontal or extends at a slight slope with respect to the direction of rotation, the respective upper mold member is held so as to be movable with respect to the endless chain while the lower mold member constitutes a stationary component with respect to the endless chain.

To secure its position at least in the region of the mold chamber, each mold member of each mold member pair that is movable with respect to the endless chain is equipped with two supporting rollers. If necessary, the mold member which is stationary with respect to the endless chain may also be equipped with a supporting roller which is disposed opposite one of the supporting rollers of the movable mold member with respect to the mold chamber.

The mobility of each mold member required to release the casting can be realized by means of a straight guide at which the movable mold member is held so as to be displaceable transversely to the longitudinal axis of the mold chamber with respect to the stationary mold member. In a particularly simple embodiment of the invention, the straight guide is composed of a guide rod held at the endless chain along which the movable mold member is able to move into a closed position and into an open position. Such a straight section has the advantage that the cooperating mold members can also be moved linearly with respect to one another even in the closed position so as to permit the already mentioned shrinkage compensation.

However, each mold member pair may also be equipped with a rotary connection by way of which the movable mold member is pivotally held with respect to the stationary mold member. The rotary connection should have enough play that the contacting mold members are able to perform a compensatory movement corresponding to the shrinkage of the metal such that two oppositely disposed mold wall sections are able to approach one another. Such a rotary connection can be realized, for example, in that the associated axis of rotation is mounted so as to also be displaceable to a sufficient extent in the transverse direction.

If the mold member pairs are equipped with a rotary connection, the opening stroke at the end of the mold member may be effected by a spring element with which the movable mold member is pivoted into the open position.

Preferably each movable mold member, by way of its supporting rollers, lies alternatingly against a closing guide and an opening guide, each equipped with an adjustable section which effects the closing or opening movement, respectively. At least the closing guide and advisably also the opening guide is configured, following its adjustable section, so that the movable mold member remains in the open or closed position, respectively, over the length of the mold chamber, or until it approaches the adjustable section of the closing guide upstream of the mold chamber.

DESCRIPTION OF THE PREFERRED EMBODIMENT

Figure 1:
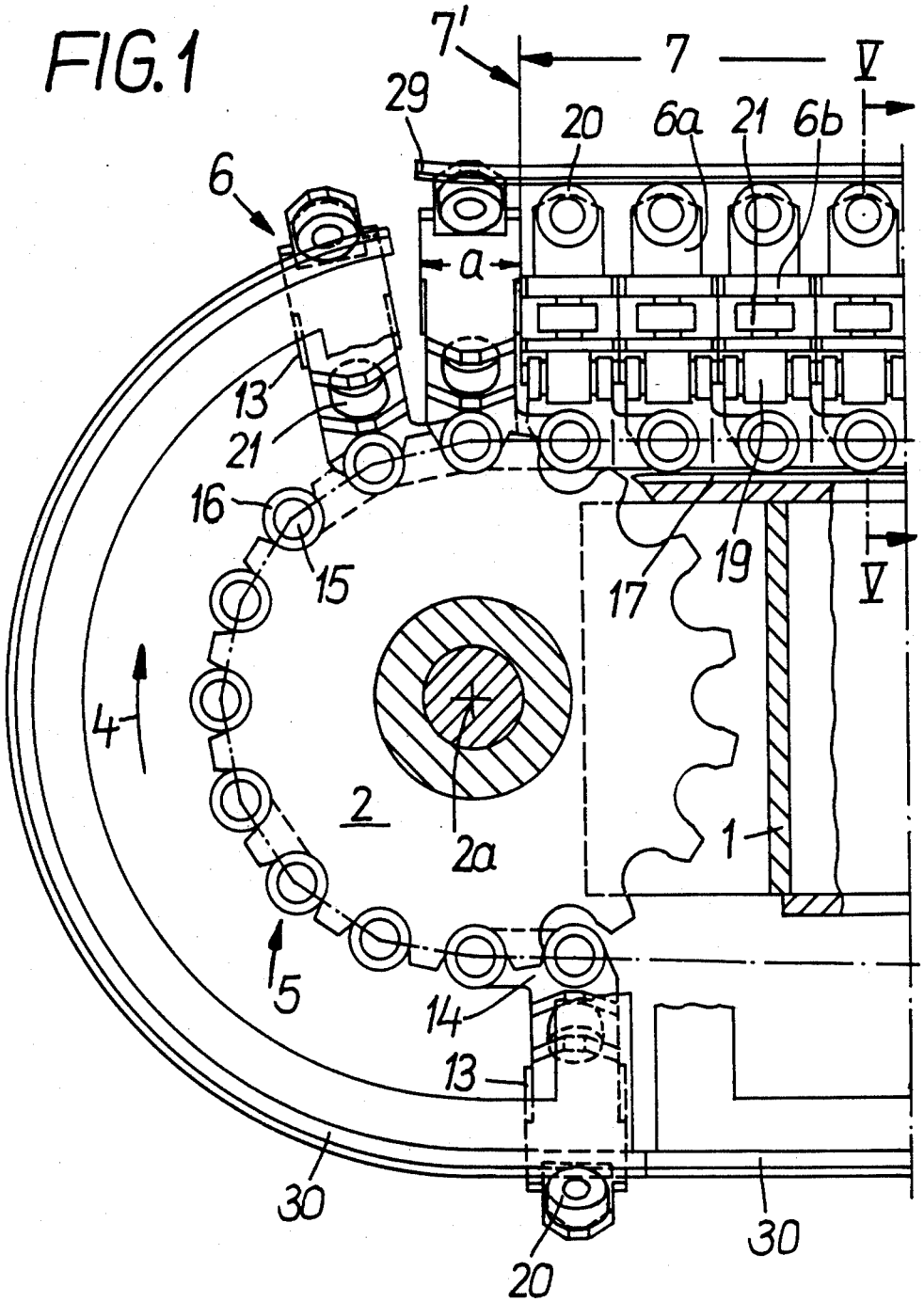
FIG. 1 is a side view, partially in section, of a portion of a casting device according to the invention, and illustrates the region at the metal intake and the front, driven chain wheel.
Figure 2:
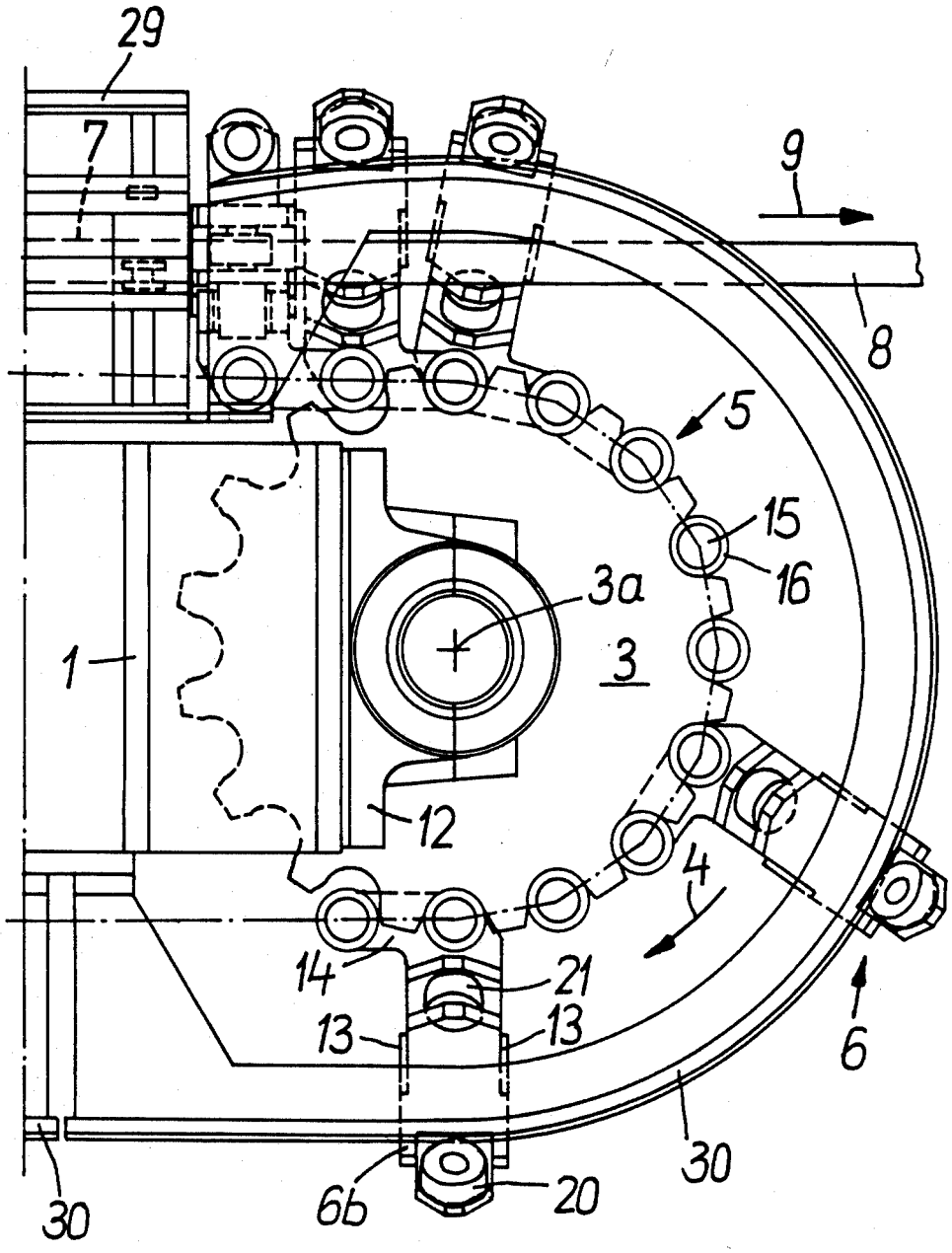
FIG. 2 is a side view of another portion of the casting device, and illustrates the region at the end of the mold chamber and the rear chain wheel.

With reference to FIGS. 1 through 4, a casting device according to the present invention includes two chain wheels 2 and 3 mounted in a frame 1. Chain wheels 2 and 3 rotate about stationary axes of rotation 2*a* and 3*a*, respectively, and support an endless chain 5. Chain 5 rotates in the direction of arrow 4. On its outward facing side, chain 5 is provided with a plurality of successive mold member pairs 6 which are moved in the direction of rotation (arrow 4). To avoid obscuring the drawings, not all of the mold member pairs 6 are shown in FIGS. 1 and 2. Each mold member pair 6 includes components (see in this connection, for example, FIGS. 5 and 6) which are movable relative to one another, as will be discussed, and which are able to define with one another a mold chamber section having the length a. The mold chamber sections of a plurality of mold member pairs 6 provide an elongated mold chamber 7. In the illustrated embodiment, the horizontal longitudinal axis 7*a* of mold chamber 7 (see in this connection, for example, FIG. 5) extends above the endless chain 5. The length of mold chamber 7 is slightly less than the mutual spacing of axes of rotation 2*a* and 3*a* of chain wheels 2 and 3. The metal to be processed is fed to mold chamber 7 in the liquid state above the front chain wheel 2, at about the position marked 7' in FIG. 1, through a casting trough (not shown) or through a closed casting nozzle (not shown) made of a refractory ceramic. The metal begins to solidify in mold chamber 7 and forms a casting skin which increases in thickness in the direction of rotation (arrow 4). The metal leaves mold chamber 7 in the region above the rear chain wheel 3 in the direction of arrow 9 as a partially solidified casting 8 (see FIG. 2).

The length of mold chamber 7, and thus the number of mold member pairs 6 cooperating in its formation, is dimensioned so that casting 8 has a sufficiently strong skin at the outlet end of mold chamber 7. Mold member pairs 6 are cooled at least in the region of mold chamber 7.

The front chain wheel 2 is supported in frame 1 by way of bearings 10 (see FIG. 3) and is in communication via a coupling 11 with a drive motor (not shown). The rear chain wheel 3 is held in frame 1 by way of bearings 12 (see FIG. 4). Mold member pairs 6, which cooperate with one another in the mold chamber region above chain wheels 2 and 3, lie against one another by way of their mutually facing frontal faces 13 (see FIG. 1) which are disposed in the direction of rotation (arrow 4). The mold chamber pairs 6 form an uninterrupted mold chamber 7 of sufficient length.

Figure 5:
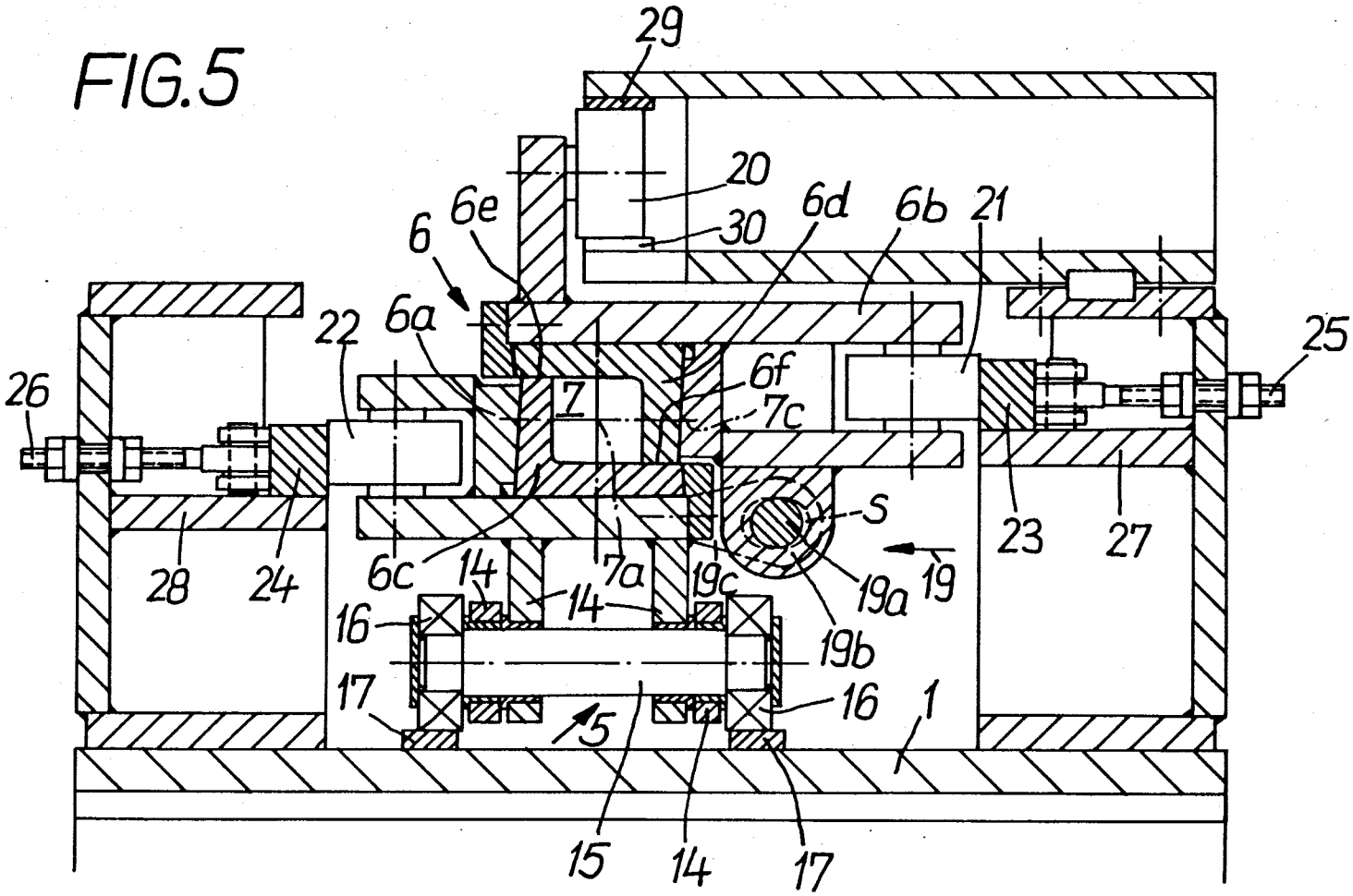
FIG. 5 is a partial sectional view, taken along line V—V of FIG. 1, and illustrates a pair of mold members in the closed position, the movable mold member being held by way of a rotary connection.

Endless chain 5 is composed of pairs of cooperating angle webs 14 which are supported at chain bolts 15 that are each fastened to a mold member pair 6 (see in this connection, for example, FIG. 5). Each chain bolt 15 is equipped at its side with two roller bearings 16 by way of which the chain 5 is supported on a linear guide path in the region of mold chamber 7. This guide path is composed of two chain tracks 17 fastened to frame 1. As can be seen particularly in FIG. 1, angle webs 14 support each mold member pair 6 at two chain bolts 15, that is, not only at the chain bolt 15 below the respective mold member pair 6 but also at the preceding chain bolt 15 in the direction of rotation (arrow 4). Chain tracks 17 ensure that the mold member pairs 6 disposed within their range are able to move only in a straight line.

Figure 6:
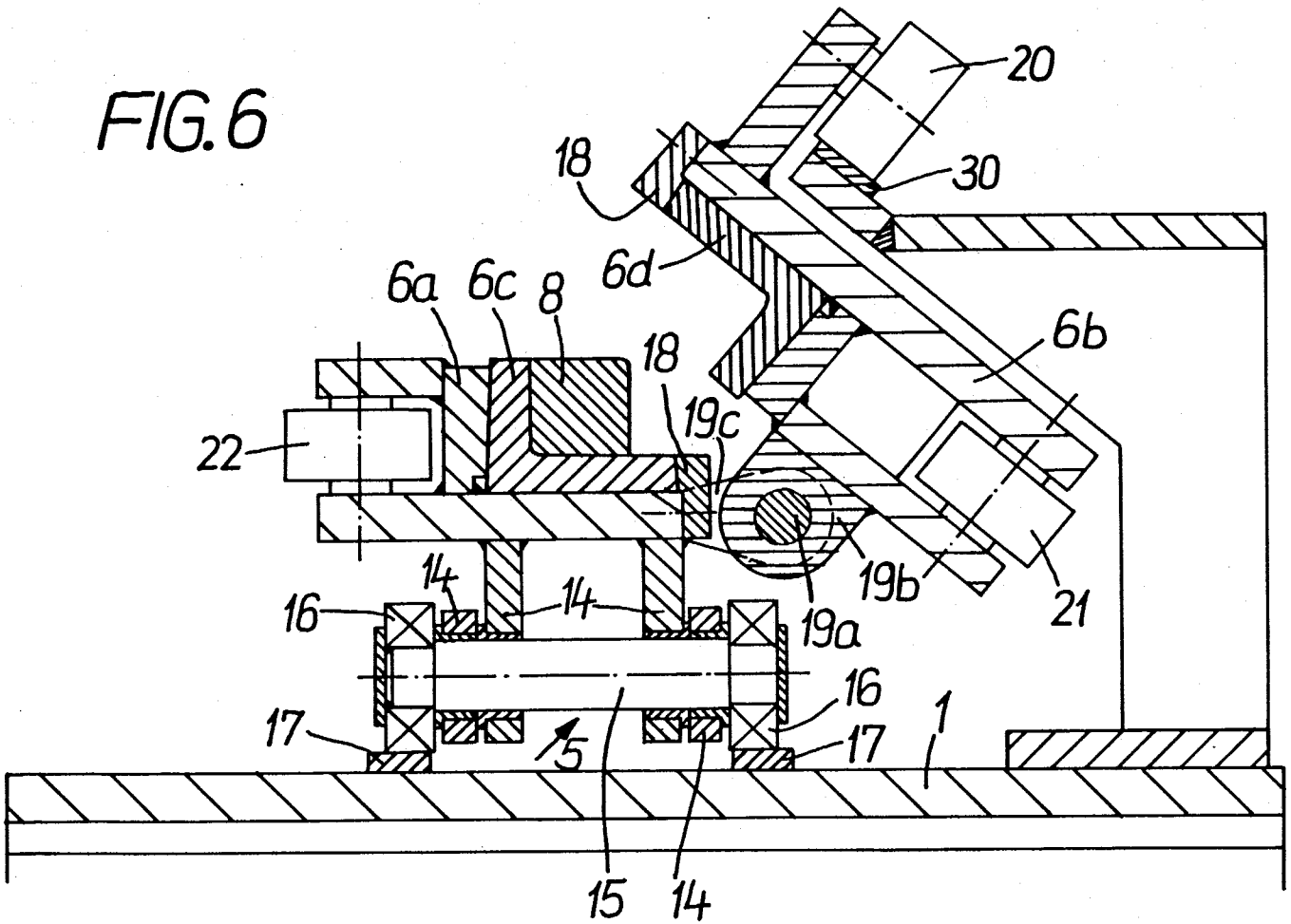
FIG. 6 is a partial sectional view of the mold member pair of FIG. 5 in the open position.

With reference next to FIGS. 5 and 6, each mold member pair 6 has two mold members 6*a* and 6*b* which form brackets and are movable relative to one another. At each mold member there is releasably attached by way of a clamping jaw 18, for example by means of clamping screws (not illustrated), an angled mold wall section 6*c* and 6*d*, respectively, composed of a heat resistant copper alloy. Contact faces 6*e* and 6*f*, by way of which mold wall sections 6*c* and 6*d* can support one another, are oriented with respect to a common reference plane—for example, with respect to the horizontal plane 7*c* through longitudinal axis 7*a* of the mold chamber 7 indicated in FIG. 5—at the same angle of inclination; in the illustrated embodiment this angle is 0°. The equiangular orientation of contact faces 6*e* and 6*f* makes it possible to laterally displace the closely adjacent mold wall sections 6*c* and 6*d* relative to one another and thus to vary the width of mold chamber 7 for shrinkage compensation. In the normal case, the mold member pairs 6 are cooled by air in the region of the mold chamber 7, i.e. their mold wall sections 6*c* and 6*d* have no thermal insulation. However, to reduce the temperature in the mold member pairs 6, the casting device is preferably equipped with a cooling unit (not illustrated), preferably disposed outside of the region of the mold chamber 7 between the chain wheels 2 and 3. A gaseous or liquid coolant may be supplied by this cooling unit to the passing mold member pairs 6.

In the embodiment of the invention shown in FIGS. 5 and 6 (and in the modified embodiment which will be discussed later with respect to FIG. 7), mold members 6*a* and 6*b* of each mold member pair 6 (see in this connection FIG. 1) are movably fastened to one another by way of a rotary connection 19. Rotary connection 19 includes a hinge bar 19*a* which is fixed to mold member 6*b* by way of an intermediately disposed counterbearing 19*b* and is in movable connection with mold member 6*a*. Counterbearing 19*c* is supported, with play s (see FIG. 5), at hinge bar 19*a* so that the cooperating pairs 6 of mold members and the associated mold wall sections 6*c* and 6*d* can also be moved laterally with respect to one another in the closed position shown in FIG. 5.

Each movable mold member 6*b* is equipped with an upper supporting roller 20 and with a lateral supporting roller 21 arranged perpendicularly thereto. Each mold member 6*a* is stationary with respect to endless chain 5 and is equipped with a lateral support roller 22; the latter lies opposite support roller 21 with respect to mold chamber 7. The above-mentioned lateral support rollers 21 and 22 each roll along a guide rail 23 and 24, respectively, which is adjustably mounted by a bar 25 or 26, respectively. Guide rails 23 and 24 rest on holding faces 27 and 28, respectively, fastened to frame 1.

The mold member pairs 6 forming mold chamber 7 are held in the closed position (in which mold wall sections 6*c* and 6*d* lie against one another by way of contact faces 6*e* and 6*d*) so that the upper support roller 20 is supported from the bottom at a closing guide 29 which is stationary with respect to frame 1. The length of closing guide 29 approximately coincides with the length of the mold chamber 7, that is, closing guide 29 is slightly shorter than the above-mentioned mutual spacing between chain wheel axes 2*a* and 3*a* (see in this connection FIGS. 1 and 2).

Figure 3:
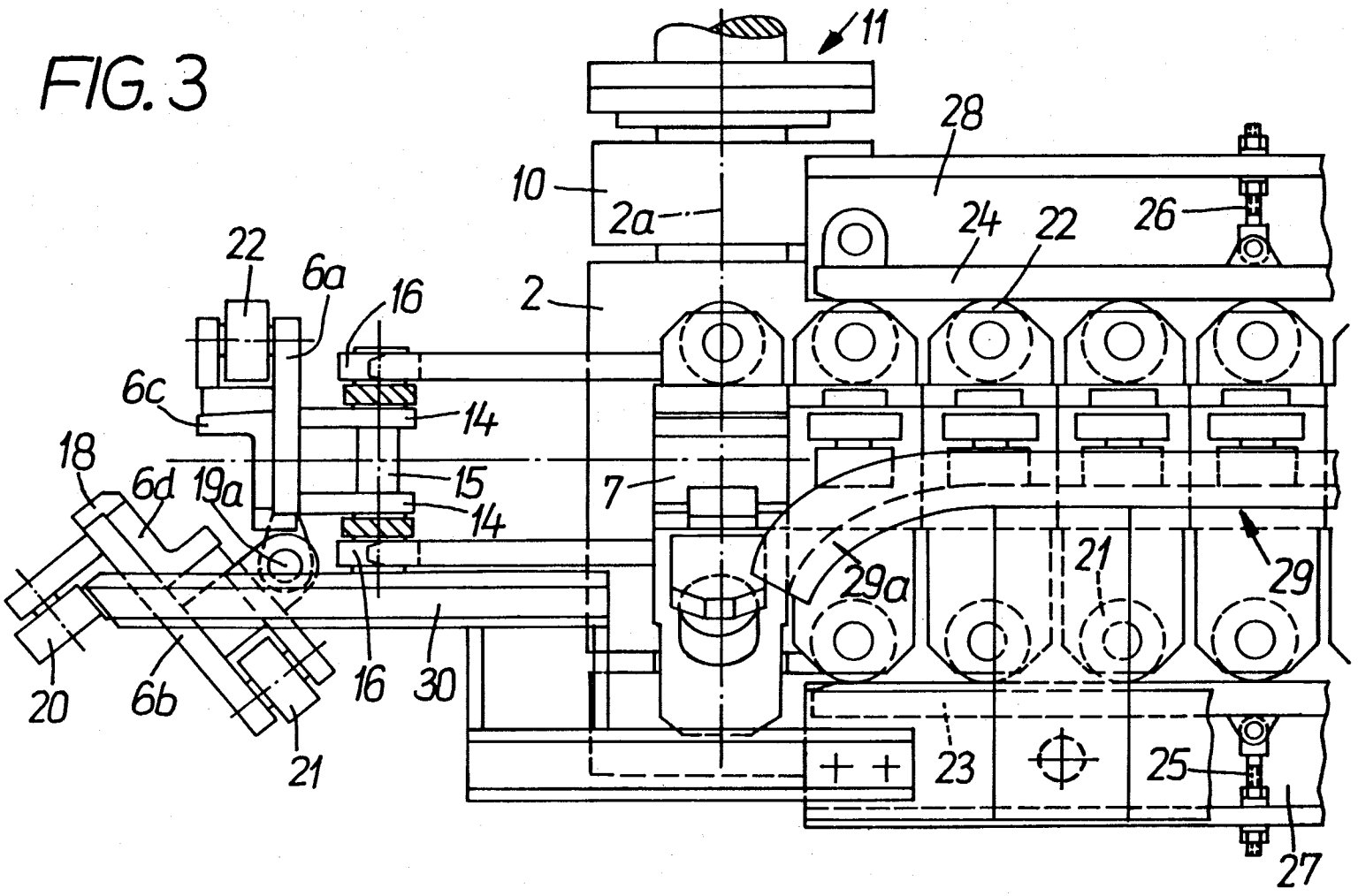
FIG. 3 is a top view of a portion of the casting device according to the invention, and illustates the region at the metal intake.

Outside of the region of the mold chamber 7, supporting roller 20 rolls along a stationary opening guide 30 (see FIGS. 1 through 3). Opening guide 30 is of such configuration that the movable mold member 6*b* following the end of the mold chamber 7 can be pivoted up clockwise and retained in this opened position during the further rotating movement (see in this connection FIG. 6).

In the region upstream of the mold chamber 7, closing guide 29 is provided with an adjustable section 29*a* with which the slope of the upper support roller 20 can be reduced gradually until mold member 6*b* has reached and maintains the closed position shown in FIG. 5. The retention of mold member 6*b* in the open position shown in FIG. 6 is a prerequisite for the sufficiently solidified casting 8 to be transported in a straight line out of the region of the casting device. As was previously mentioned a stationary feed device (not illustrated) for molten metal can be disposed in the region upstream of the mold chamber 7, with the front portion of this metal feed device projecting into the mold chamber 7. Since the rotary connection between the mold members 6*a* and 6*b* of each mold member pair 6 has a certain amount of play, shrinkage occurring in the mold chamber 7 can in part be compensated by lateral displacement of the mold members 6*a* and 6*b* with respect to one another; the cross-sectional dimensions of the mold chamber 7 can be changed or fixed, respectively, by adjusting the position of guide rails 23 and 24 (see FIG. 5).

Figure 4:
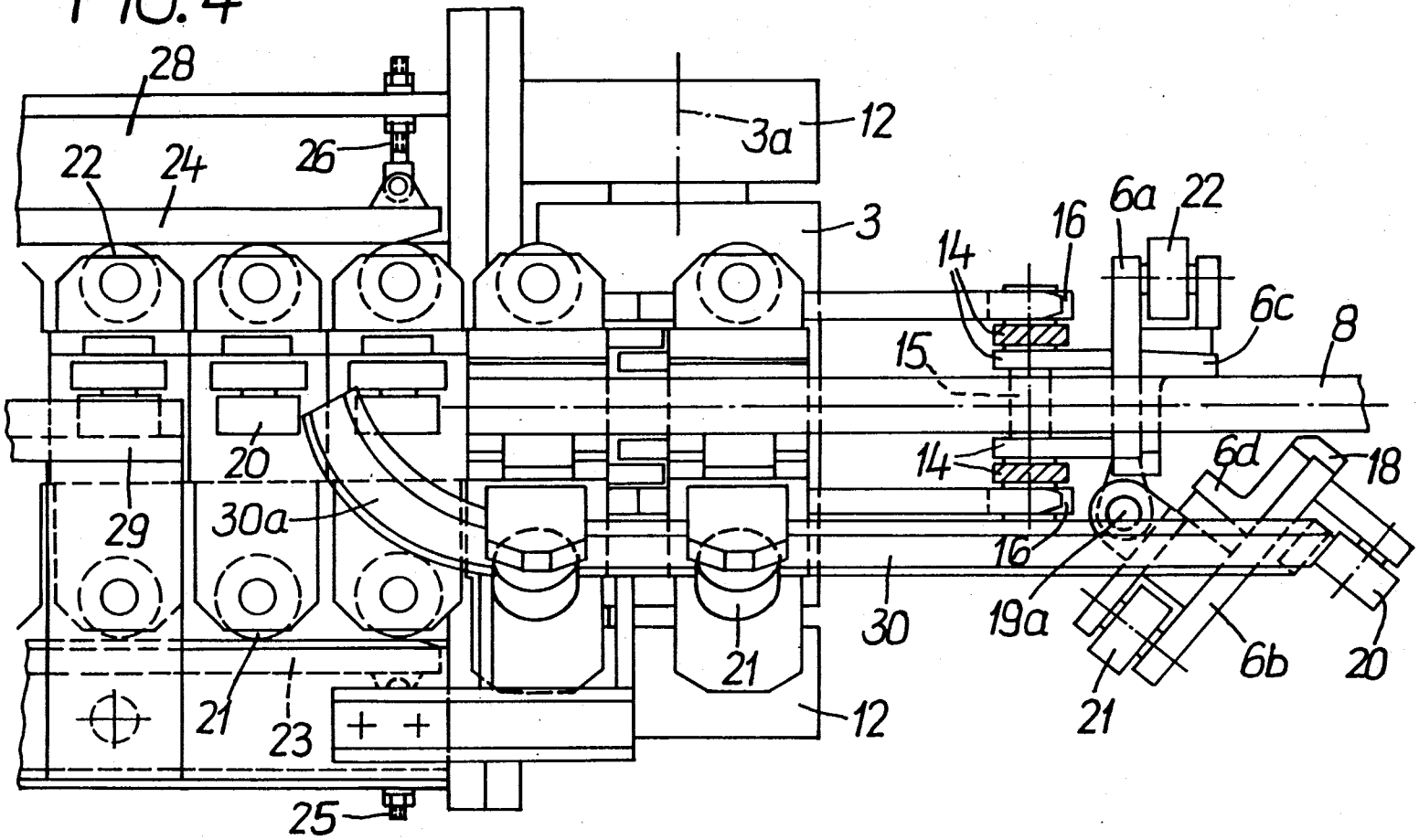
FIG. 4 is a top view of another portion of the casting device according to the invention, and illustrates the region at the end of the mold chamber.

Adjustment sections 29*a* and 30*a* of closing guide 29 and opening guide 30, respectively, where displacement of mold member pairs 6 into the closed or open position occurs, are shown schematically in FIGS. 3 and 4, respectively.

Figure 7:
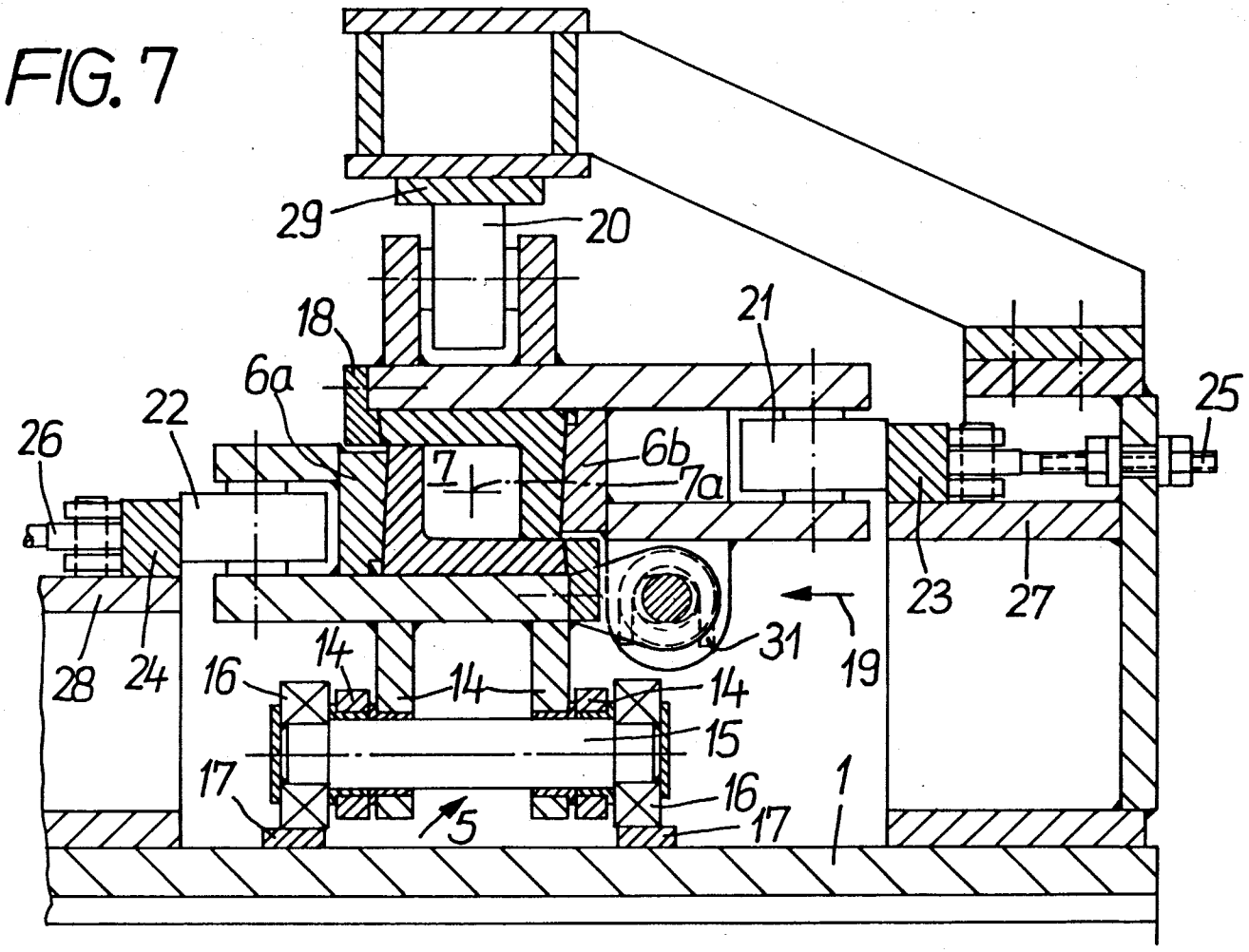
FIG. 7 is a partial sectional view of a modified embodiment of a mold member pair in the closed position, the modified mold member pair being equipped with a rotary connection as in FIG. 5 and with an opening spring.

The embodiment of the invention shown in FIG. 7 differs from the above-described embodiment essentially in that the rotary connection 19 between mold members 6*b* and 6*a* is additionally equipped with a spring element 31 in the form of a rotary spring. The latter is simultaneously connected with members 19*b* and 19*c* and exerts a resetting force with which the movable mold member 6*b* can be pivoted upwardly in a clockwise direction as soon as the upper supporting roller 20—outside the region of the mold chamber—is no longer supported at the closing guide 29. Since mold member pairs 6 are moved automatically into the open position under the influence of spring element 31, the use of an opening guide can be omitted. The spring element 31 is configured in such a manner and/or is held at parts 19*b* and 19*c* in such a manner that it does not impede displacement of abutting mold members 6*a* and 6*b* in the order of magnitude of a few tenths of a millimeter. The hinge bar 19*a* then engages with sufficient play s (not marked in FIG. 7; see FIG. 5) in counterbearing 19*c* of stationary mold member 6*a*.

Within the scope of the invention, the spring element 31 may also be configured and arrangement in a manner other than illustrated. In particular, it is possible to employ a compression spring which is supported at counterbearing 19*c* between mold wall section 6*d* and support roller 21 at movable mold member 6*b*.

Figure 8:
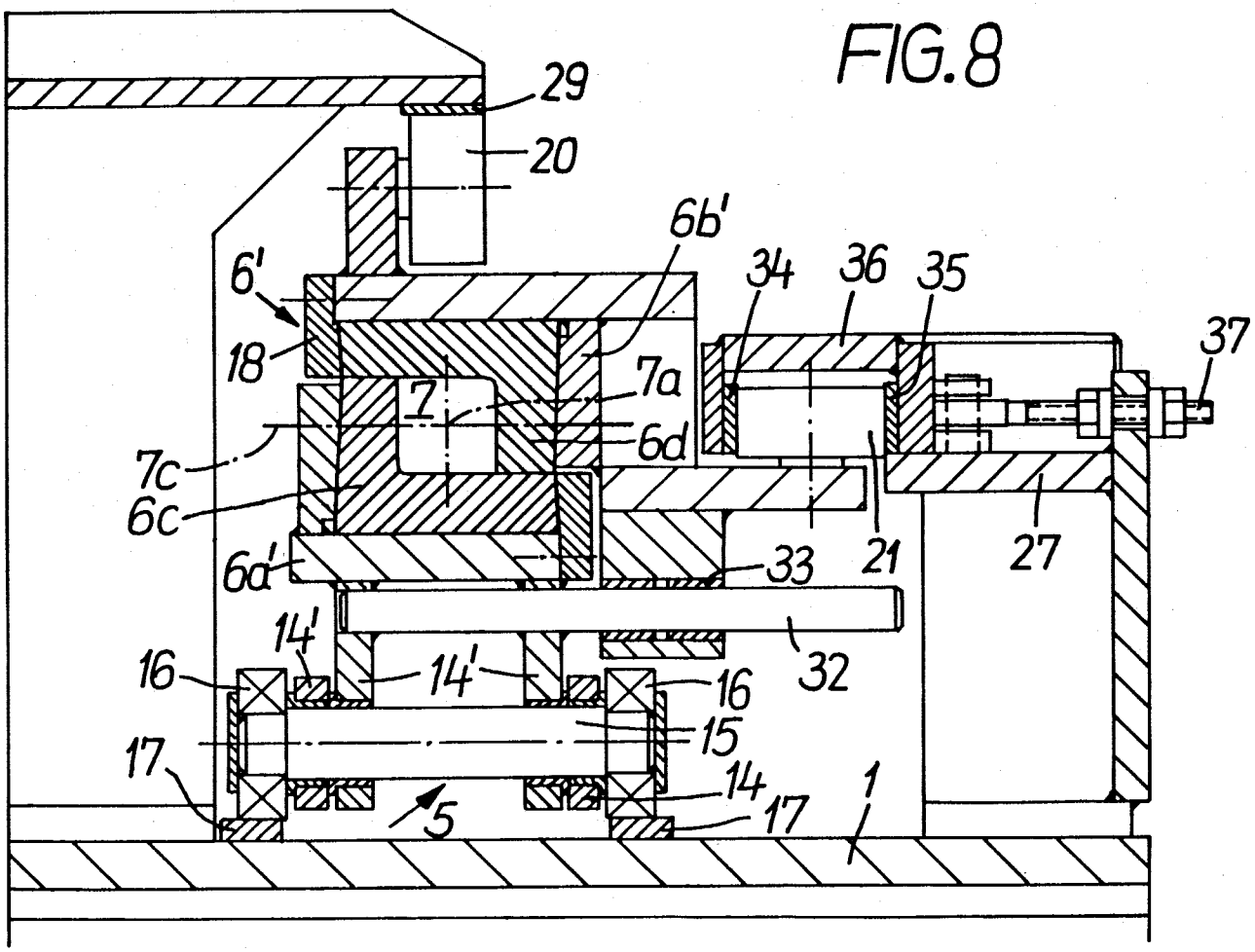
FIG. 8 is a partial sectional view of another embodiment of a pair of mold members in the closed position, and illustrates a linear guide supporting the movable mold member.
Figure 9:
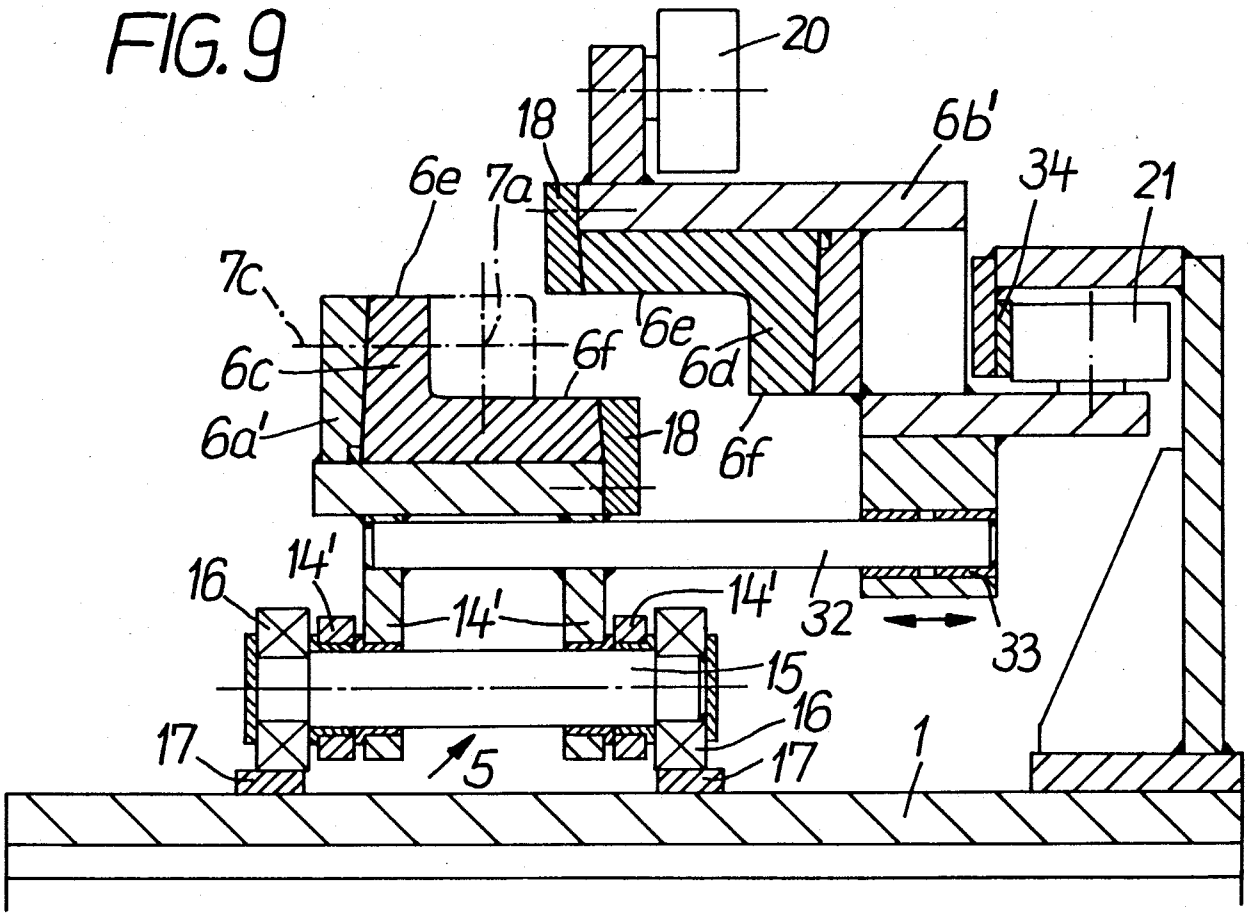
FIG. 9 is a partial sectional view of the embodiment of FIG. 8 in the open position.

The embodiment according to FIGS. 8 and 9 differs basically from the previously described embodiments in that the movable mold member 6*b*′ of each mold member pair 6′ is linearly displaceable with respect to stationary mold member 6*a*′ and in that only the movable mold member 6*b*′ is equipped with perpendicularly oriented supporting rollers 20 and 21. The linear guide is composed of a guide rod 32 fastened to the angular webs 14′ of endless chain 5 and oriented transversely to the longitudinal axis 7*a* of the mold chamber 7′. Mold member 6*b*′ is supported by way of slide bushings 33.

The lateral position of mold section 6*b*′ with respect to stationary mold member 6*a*′ and endless chain 5 is fixed in that the lateral support roller 21 is held over the length of the mold chamber 7 with very little play between an inner guide rail 34 and an outer guide rail 35. Both guide rails are components of a guide cage 36 which displaceably rests on holding face 27 and can be fixed in the desired position by way of an adjustable connection bar 37. The seal between mold wall sections 6*c* and 6*d* is effected in the manner discussed above in that the upper support roller 20 is supported at closing guide 29.

Closing guide 29 and outer guide rail 35 exist only in the mold chamber region. Following an adjustment section (not shown), inner guide rail 34 is arranged with respect to stationary mold member 6*a*′ and endless chain 5 in such a manner that mold member 6*b*′, which is pushed to the right by way of supporting roller 21, releases mold chamber 7 and thus permits removal of the produced casting (FIG. 9).

The guide rail 35 shown in FIG. 8 also has an adjustment section in the region upstream of the mold chamber 7 through which the movable mold member 6*b*′ is moved back into the closed position (shown in FIG. 8) when the respective mold member pair 6 approaches the mold chamber 7.

Due to the configuration including a linear guide, the width of the mold chamber 7 in the embodiment of FIGS. 8 and 9 can easily be adapted to the shrinkage which occurs in mold chamber 7 during the solidification of the liquid metal.

The advantage realized with the invention is, in particular, that the use of two cooperating mold members enables the production of a mold chamber section which is sealed toward the exterior, with the cross section being changeable in one direction by displacement of the closely contacting mold members. The mold member pairs forming the mold chamber rotate on a single supporting element in the form of an endless chain.

Since the angled mold wall sections are releasably fastened in the easily accessible mold sections, individual mold wall sections can be exchanged without difficulty and, if necessary, the casting device can also be equipped with mold wall sections which define a mold chamber having a different cross section.

The present disclosure relates to the subject matter disclosed in European patent application No. 86 117 792.1, filed Dec. 19, 1986, the entire disclosure of which is incorporated herein by reference.

It will be understood that the above description of the present invention is susceptible to various modifications, changes and adaptations, and the same are intended to be comprehended within the meaning and range of equivalents of the appended claims.

What we claim is:

1. A metal casting device, comprising:

an endless chain;

first means for mounting the chain and for continuously moving the chain along a chain path in a predetermined direction of rotation, the first means including front and rear chain wheels;

second means for providing an elongated mold chamber disposed adjacent a portion of the chain path, the mold chamber having a metal intake end in the region of the front chain wheel and having a metal release end which is spaced apart from the intake end in the direction of rotation, the release end of the mold chamber being disposed in the region of the rear chain wheel, the second means including a plurality of pairs of mold members which are fastened to the chain and which lie adjacent one another in the direction of rotation, a portion of the plurality of pairs of mold members cooperating to form the mold chamber, each pair of mold members being movable relative to each other between an open position and a closed position which provides a section of the mold chamber, each mold member of a pair having a respective contact face which touches the other mold member of the pair when the pair of mold members is in its closed position, with the contact faces of a pair of mold members in the closed position having the same angle of inclination with respect to a reference plane and being disposed at different distances from the chain path; and third means for moving the mold member pairs to their closed position in the region of the intake end of the mold chamber and for moving the mold member pairs to their open position in the region of the release end of the mold chamber, the third means including stationary guides and, for each pair of mold members, a respective plurality of differently oriented supporting rollers which engage the guides at least in the region of the mold chamber to keep the mold members of the respective pair in contact with each other while forming a mold chamber section.

2. The casting device of claim 1, wherein the mold chamber has a longitudinal axis, and wherein each mold member comprises a mold wall section having an angular configuration in a plane perpendicular to the longitudinal axis.

3. The casting device of claim 1, wherein the chain comprises roller bearings, and wherein the first means comprises guide means for supporting the roller bearings at least in the region of the mold chamber.

4. The casting device of claim 3, wherein the chain further comprises transverse chain bolts, a pair of roller bearings being mounted on each transverse chain bolt, and wherein each pair of mold members is fastened to the chain via two successive transverse chain bolts.

5. The casting device of claim 1, wherein one mold member of each pair is an outer mold member which is disposed further from the chain than the other mold member of the respective pair, the outer mold member being movable with respect to the chain and comprising a mold wall section.

6. The casting device of claim 1, wherein one mold member of each pair is a movable mold member which is movable with respect to the chain, and wherein the respective plurality of supporting rollers of the third means includes two rollers which are connected to the movable mold member.

7. The casting device of claim 6, wherein one of the mold members of each pair is a stationary mold member which is stationary with repsect to the chain, and wherein the respective plurality of supporting rollers of the third means further includes another roller which is connected to the stationary mold member and which lies opposite one of the rollers connected to the respective movable mold member with respect to the mold chamber.

8. The casting device of claim 6, wherein one of the mold members of each pair is a stationary mold member which is stationary with respect to the chain, and wherein for each pair of mold members the second means further comprises means for rotatably connecting the movable mold member of the pair to the stationary mold member of the pair.

9. The casting device of claim 8, wherein the casting device is employed to cast metal, and wherein the means for rotatably connecting provides a degree of play which permits the respective mold members to move when in the closed position to compensate for shrinkage of the metal.

10. The casting device of claim 8, wherein for each pair of mold members the second means further comprises a spring element to rotate the movable mold member to the open position.

11. The casting device of claim 6, wherein the stationary guides of the third means include a closing guide and an opening guide, wherein one of the supporting rollers connected to each movable mold member lies alternatingly against the closing guide and the opening guide, and wherein the guides have adjustment sections to produce the closing or opening movements, respectively.

12. The casting device of claim 1, wherein the mold chamber has a transverse axis, and wherein one of the mold members of each pair is a movable mold member which is movable with respect to the chain and one of the mold members of each pair is a stationary mold member which is stationary with respect to the chain, and wherein for each pair of mold members the second means further comprises a linear guide along which the movable mold member is guided for movement transverse to the longitudinal axis of the mold chamber, the movement occurring transverse to the stationary mold member of the pair.

13. The casting device of claim 1, wherein the supporting rollers and stationary guides of the third means are disposed outside the chain.

14. A metal casting device, comprising:

an endless chain;

first means for mounting the chain and for continuously moving the chain along a chain path in a predetermined direction of rotation, the first means including front and rear chain wheels;

second means for providing an elongated mold chamber disposed adjacent a portion of the chain path, the mold chamber having a metal intake end in the region of the front chain wheel and having a metal release end which is spaced apart from the intake end in the direction of rotation, the release end of the mold chamber being disposed in the region of the rear chain wheel, the second means including a plurality of pairs of mold members which are fastened to the chain and which lie adjacent one another in the direction of rotation, a portion of the plurality of pairs of mold members cooperating to form the mold chamber, each pair of mold members being movable relative to each other between an open position and a closed position which provides a section of the mold chamber, each mold member of a pair slidably contacting the other mold member of the pair when the pair of mold members is in its closed position; and third means for moving the mold member pairs to their closed position in the region of the intake end of the mold chamber and for moving the mold member pairs to their open position in the region of the release end of the mold chamber, the third means including stationary guides and, for each pair of mold members, a respective plurality of differently oriented supporting rollers which engage the guides at least in the region of the mold chamber to keep the mold members of the respective pair in contact with each other while forming a mold chamber section.

* * * * *